United States Patent [19]

Steck et al.

[11] 4,439,231

[45] Mar. 27, 1984

[54] PREPARATION OF ACICULAR FERROMAGNETIC METAL PARTICLES CONSISTING ESSENTIALLY OF IRON

[75] Inventors: Werner Steck, Ludwigshafen; Peter Rudolf, Neuhofen; Wilhelm Sarnecki, Limburgerhof; Werner Loeser, Ludwigshafen; Jenoe Kovacs, Hessheim; Helmut Jakusch, Frankenthal, all of Fed. Rep. of Germany

[73] Assignee: BASF Aktiengesellschaft, Fed. Rep. of Germany

[21] Appl. No.: 518,000

[22] Filed: Jul. 28, 1983

[30] Foreign Application Priority Data

Jul. 31, 1982 [DE] Fed. Rep. of Germany ..... 3228669

[51] Int. Cl.[3] ..... B22F 9/22

[52] U.S. Cl. ..... 75/0.5 AA; 75/0.5 BA; 148/105

[58] Field of Search ..... 75/0.5 AA, 0.5 BA; 148/105

[56] References Cited

U.S. PATENT DOCUMENTS

| | | | |
|---|---|---|---|
| 4,017,303 | 4/1977 | Koester et al. | 75/0.5 AA |
| 4,155,748 | 5/1979 | Steck et al. | 75/0.5 BA |
| 4,178,171 | 12/1979 | Steck et al. | 148/105 |

FOREIGN PATENT DOCUMENTS

| | | |
|---|---|---|
| 1907691 | 3/1968 | Fed. Rep. of Germany . |
| 2014500 | 4/1969 | Fed. Rep. of Germany . |
| 1592398 | 2/1971 | Fed. Rep. of Germany . |
| 2436096 | 10/1973 | Fed. Rep. of Germany . |
| 2434058 | 7/1974 | Fed. Rep. of Germany . |
| 2646348 | 10/1976 | Fed. Rep. of Germany . |
| 2714588 | 4/1977 | Fed. Rep. of Germany . |
| 121799/77 | 4/1976 | Japan . |
| 153198/77 | 6/1976 | Japan . |

*Primary Examiner*—W. Stallard

*Attorney, Agent, or Firm*—Keil & Witherspoon

[57] ABSTRACT

Acicular ferromagnetic metal particles consisting essentially of iron are prepared by a process wherein acicular iron(III) oxide hydroxide provided with a shape-stabilizing surface coating, or iron(III) oxide obtained therefrom by dehydration, is reduced by means of a decomposable organic compound and hydrogen.

2 Claims, No Drawings

PREPARATION OF ACICULAR FERROMAGNETIC METAL PARTICLES CONSISTING ESSENTIALLY OF IRON

The present invention relates to a process for the preparation of acicular ferromagnetic metal particles consisting essentially of iron by reducing acicular iron-(III) oxide hydroxide provided with a shape-stabilizing surface coating, or the iron(III) oxide obtained therefrom by dehydration, by means of a decomposable organic compound and hydrogen.

Owing to their high saturation remanence and high coercive force, acicular ferromagnetic metal particles are particularly useful for the production of magnetic recording media.

It is known that iron particles can be prepared by reducing finely divided acicular iron compounds, for example the oxides, with hydrogen or another gaseous reducing agent. For the reduction to take place at a velocity which is industrially acceptable, it has to be carried out at above 300° C. However, this is attended by the problem of sintering of the metal particles that are formed, as a result of which the particles no longer have the shape necessary for achieving the requisite magnetic properties.

In order to reduce the temperature at which the reduction takes place, it has been proposed that this reduction be catalyzed by applying silver or a silver compound to the surface of finely divided iron oxide (German Laid-Open Application DOS No. 2,014,500). The treatment of the iron oxide with tin(II) chloride has also been described (German Laid-Open Application DOS No. 1,907,691).

Attempts to provide the iron oxides to be reduced with a surface coating in order to prevent the sintering of the individual particles brought about by the necessary, high reduction temperature, as described in, for example, German Laid-Open Applications DOS Nos. 2,434,058, DOS 2,434,096, DOS 2,646,348 and DOS 2,714,588, have not been completely successful either.

It is an object of the present invention to provide a process for the preparation of acicular ferromagnetic metal particles consisting essentially of iron, which process gives, in a simple manner, particles which have a pronounced anisotropic shape, are very finely divided and possess a narrow particle size distribution and a high coercive force.

We have found that this object is achieved, and that acicular ferromagnetic metal particles consisting essentially of iron can be obtained by reducing acicular iron-(III) oxide hydroxide provided with a shape-stabilizing surface coating, or the iron(III) oxide obtained therefrom by dehydration, if the reduction is carried out with a decomposable organic compound and hydrogen at from 270° to 450° C.

It is particularly advantageous if, in a first stage, the iron(III) oxide hydroxide or iron(III) oxide provided with a surface coating is reduced with a decomposable organic compound in an inert gas atmosphere at from 270° to 650° C. to $FeO_x$, where x is from 1.33 to 1.44, and, in a second stage, this product is reduced with hydrogen at from 270° to 450° C. to the metal.

A suitable starting material for the novel process is an iron(III) oxide hydroxide in the form of a mixture of 80–100% of α-FeOOH and 0–20% of γ-FeOOH, or of 70–100% of γ-FeOOH and 0–30% of α-FeOOH. The appropriate iron(III) oxide hydroxides advantageously have a BET surface area of not less than 20 and not more than 120 $m^2/g$, a mean particle length of from 0.10 to 1.5 μm and a length/width ratio of not less than 5:1, advantageously from 8 to 40:1. The iron(III) oxides obtained by dehydrating the said iron(III) oxide hydroxides at above 250° C. are equally suitable. To prepare metal particles which in addition to iron contain other alloy components, such as cobalt, nickel and/or chromium, iron oxides appropriately modified in a conventional manner are employed as starting materials.

These iron(III) oxide hydroxides or iron(III) oxides are then provided in a conventional manner with a shape-stabilizing surface coating which helps to retain the particle shape during the further conversion steps. A suitable method of doing this is, for example, to treat the iron(III) oxide hydroxides or iron(III) oxides with an alkaline earth metal cation and a carboxylic acid or another organic compound which has two or more groups capable of chelate formation with the alkaline earth metal cation. These methods are described in German Laid-Open Application DOS Nos. 2,434,058 and DOS 2,434,096.

Another known method, which is described in German Laid-Open Application DOS No. 2,646,348, comprises treating the surfaces of the iron(III) oxide hydroxides or iron(III) oxides, in order to stabilize their shape, with hydrolysis-resistant oxyacids of phosphorus, their salts or esters and aliphatic monobasic or polybasic carboxylic acids. Suitable hydrolysis-resistant substances are phosphoric acid, soluble mono-, di- and triphosphates, eg. potassium dihydrogen phosphate, ammonium dihydrogen phosphate, disodium orthophosphate, dilithium orthophosphate, trisodium phosphate and sodium pyrophosphate, and metaphosphates, eg. sodium metaphosphate. The compounds can be used alone or as mixtures with one another. Advantageously, the esters of phosphoric acid with aliphatic monoalcohols of 1 to 6 carbon atoms, eg. tert.-butyl esters of phosphoric acid, are employed. For the purposes of the present invention, carboxylic acids are saturated or unsaturated aliphatic carboxylic acids which are of not more than 6 carbon atoms and contain no more than 3 acidic groups, and in which one or more hydrogen atoms of the aliphatic chain may be substituted by hydroxyl or amino. Particularly suitable acids are oxydicarboxylic acids and oxytricarboxylic acids, eg. oxalic acid, tartaric acid and citric acid. Other shape-stabilizing treatments suitable for the novel process are the conventional surface coatings with tin compounds (German Patent No. 1,907,691) or with silicates or $SiO_2$ (Japanese Published Applications Nos. 121,799/77 and 153,198/77).

In the novel process, the iron(III) oxide hydroxides or iron(III) oxides treated in this manner are then reduced to the metal by means of a decomposable organic compound and hydrogen.

Suitable organic compounds are all organic substances which are decomposable at from 270° to 650° C. in the presence of iron oxide hydroxides or iron oxides. Suitable substances for this purpose therefore include relatively long-chain carboxylic acids and their salts, amides of long-chain carboxylic acids, long-chain alcohols, starch, oils, polyalcohols, waxes, paraffins and polymeric substances, eg. polyethylene. A high boiling point or sublimation point is advantageous because this avoids losses of organic substance before the reduction begins.

To carry out the treatment with the organic reducing agent, the iron(III) oxide hydroxide or iron(III) oxide is mechanically mixed with the solid or liquid organic substance, or is coated with this in a suitable solution or suspension of the substance. Shape-stabilization and application of the organic substance can be carried out simultaneously or in succession, for example in an aqueous suspension of the particles. Similarly, the organic compound may also be present during or before growth of the iron(III) oxide hydroxide crystals. For this purpose, the organic substance is added as early as the beginning of the FeOOH synthesis, for example before the precipitation of $Fe(OH)_2$. The organic substance may also be added after nucleation is complete, or during or after the growth stage. In these cases, formation of the shape-stabilizing surface coating takes place subsequently in the aqueous suspension of the particles, or after the filter cake has been freed from inorganic salts and suspended in water. In general, carbon contents of from 0.5 to 20% by weight, based on FeOOH or $Fe_2O_3$, are sufficient.

In carrying out the novel process, the iron(III) oxide hydroxide or iron(III) oxide provided with the surface coating and with the organic compound is reduced under a stream of hydrogen at from 270° to 450° C. The reduction time depends on the size of the batch and the type of reactor used, and is accordingly from 30 minutes to 30 hours.

Particularly advantageously, the novel process can be carried out as follows: in a first stage, the iron(III) oxide hydroxide or iron(III) oxide provided with a surface coating is reduced with the decomposable organic compound under an inert gas, usually nitrogen, at from 270° to 650° C. to $FeO_x$, where x is from 1.33 to 1.44, and in a second stage, carried out directly after the first, the $FeO_x$ is then reduced with hydrogen at from 270° to 450° C. to the metal.

The reductions, and where relevant the dehydration of FeOOH to $Fe_2O_3$ before and at the beginning of the reduction, can be carried out either batchwise or continuously, for example using a separate reactor for each stage. The choice between cocurrent and countercurrent flow for solids and gas or vapor streams depends on the number and type of reactors available, eg. rotary kiln or fluidized-bed reactor, the type of starting material, eg. FeOOH or $Fe_2O_3$, and the reduction method used. Moreover, in the case of some organic reducing agents, the organic reduction to $FeO_x$ can take place simultaneously to the dehydration of FeOOH and at the same point in the reactor; where a continuous procedure is used, the organic substance is added at a suitable point of the reactor, so that the dehydration to $Fe_2O_3$ and the organic reduction to $FeO_x$ can take place in one and the same reactor but at different points.

The acicular ferromagnetic metal particles which consist essentially of iron and are obtainable by the novel process still substantially possess the same shape as the starting materials, have a uniform particle size in spite of the transformation reaction carried out beforehand, and, depending on the starting material, are particularly finely divided. As a result of these characteristics, they possess excellent magnetic properties, such as high coercivity and in particular high remanence. The high squareness of the hysteresis loop is an indication of a narrow switching field distribution, which results from the uniform shape.

Metal particles of this type are very useful as magnetic materials for the production of magnetic recording media. However, these substances are advantageously passivated before being further processed. In the passivation procedure, the metal particles are coated with an oxide layer by controlled oxidation, in order to eliminate the pyrophoric characteristics resulting from the large free surface area of the small particles. This is achieved, for example, by passing an air/nitrogen mixture over the metal powder. Passivation may also be effected by wetting the pigments with an organic solvent in the presence of oxygen, or by means of other conventional oxidation and/or coating methods.

When used for the production of magnetic recording media, the metal particles obtainable by the novel process are particularly easy to orient magnetically. Moreover, important electroacoustic properties, such as the maximum output levels at long and short wavelengths and, as a result of the finely divided nature of the material, in particular the signal-to-noise ratio are improved.

The Examples which follow illustrate the invention. The magnetic properties of the pigments were measured with a vibrating sample magnetometer in a magnetic field of 160 kA/m or, after magnetization to saturation in a discharge capacitor, in a vibrating sample magnetometer, each pigment sample having a tamped density of $\rho = 1.6$ g/cm$^3$. The coercive force $H_c$ is given kA/m, and the specific remanence ($M_r/\rho$) and specific saturation magnetization ($M_m/\rho$) are each given in nTm$^3$/g. The specific surface area ($S_{N2}$) of the pigment was determined by the BET method ($N_2$ adsorption) and is given in m$^2$/g.

EXAMPLE 1

56 parts of a mixture containing 97% by weight of $\gamma$-FeOOH and 3% by weight of $\alpha$-FeOOH and having a specific surface area $S_{N2}$ of 37.6 cm$^2$/g were suspended in 750 parts of water while stirring vigorously. Thereafter, 2 parts of oxalic acid and 0.35 part of 85% strength phosphoric acid were added to the suspension, stirring was continued, and the solid was filtered off and dried. The treated FeOOH thus obtained contained 1.3% of $PO_4^{3-}$ and 0.14% of carbon from oxalic acid. Samples of this material, each comprising 5 parts, were mixed with 2.5% by weight (sample 1) and 5% by weight (sample 2) of stearic acid, and the mixtures were reduced in a stream of hydrogen at 350° C. for 8 hours in a rotary kiln. The resulting metal particles had the properties shown in Table 1.

COMPARATIVE EXPERIMENT 1

The procedure described in Example 1 was followed, except that the FeOOH treated with oxalic acid/phosphoric acid was reduced with hydrogen at 350° C. for 8 hours, in the absence of stearic acid. The properties are shown in Table 1.

TABLE 1

| | $H_c$ [kA/m] | $S_{N2}$ [m$^2$/g] | c [% by weight] |
|---|---|---|---|
| Example 1: | | | |
| Sample 1 | 65.2 | 27.3 | 0.22 |
| Sample 2 | 66.6 | 30.5 | 0.29 |
| Comparative Experiment 1 | 61.4 | 21.0 | 0.1 |

EXAMPLE 2

In a kettle, 2,500 parts of an $\alpha$-FeOOH obtained as described in German Published Application DAS No. 1,204,644 and having a specific surface area of 39 m$^2$/g were treated with 1% by weight of $H_3PO_4$ and 1% by weight of $H_2C_2O_4.2H_2O$, while stirring vigorously. The ratio of pigment to water was 1:16. An aqueous solution of phosphoric acid and oxalic acid was added, stirring was continued for a further 7 hours, the mixture was filtered over filter presses and the product was then dried in the air at 170° C. The treated α-FeOOH thus obtained contained 0.9% by weight of phosphate and 0.08% by weight of carbon and had a specific surface area of 36.9 $m^2/g$.

Samples of this product, each comprising 100 parts, were dry-blended with 2.5% by weight (sample 1) and 5.0% by weight (sample 2) of stearic acid. Thereafter, samples 1 and 2 were each reduced to the pyrophoric metal pigment (py) in a stream of hydrogen of 30 liters (S.T.P.)/hour. The magnetic properties of the pigments were measured, after which the remainder of each sample was passivated (pa) in a stream of 2 liters (S.T.P.)/hour of air and 30 liters (S.T.P.)/hour of nitrogen at below 60° C. The results of the measurements are shown in Table 2.

COMPARATIVE EXPERIMENT 2

Samples (100 parts each) of the FeOOH starting material employed in Example 2 were mixed directly with 2.5% by weight (sample 1) and 5% by weight (sample 2) of stearic acid, and the mixtures were processed further as described in Example 2. The results of the measurements are shown in Table 2.

TABLE 2

| | $H_c$ [kA/m] | $M_r/\rho$ [$nTm^3/g$] | $M_m/\rho$ [$nTm^3/g$] | $S_{N2}$ [$m^2/g$] |
|---|---|---|---|---|
| Example 2 | | | | |
| Sample 1 (py) | 73.3 | 82 | 137 | |
| Sample 1 (pa) | 74 | 65 | 111 | 25.6 |
| Sample 2 (py) | 69 | 91 | 147 | |
| Sample 2 (pa) | 75.4 | 62 | 107 | 27.2 |
| Comparative Experiment 2 | | | | |
| Sample 1 (py) | 62.7 | 90 | 149 | 13.7 |
| Sample 2 (py) | 50.7 | 91 | 157 | |

EXAMPLE 3

In a rotating flask, 4 ml of olive oil were added to 20 g of a γ-FeOOH which had been treated with oxalic acid/phosphoric acid and contained 0.87% by weight of $PO_4^{3-}$ and 0.08% by weight of carbon from oxalic acid, and the mixture was heated at 370° C. for 15 minutes in a stream of nitrogen. The resulting material had the composition $FeO_{1.34}$. 10 g of this product were then reduced to the metal in a stream of hydrogen for 8 hours at 350° C. The coercive force of the pyrophoric material was 73.7 kA/m.

COMPARATIVE EXPERIMENT 3

A γ-FeOOH treated with oxalic acid/phosphoric acid as described in Example 3 was reduced directly with hydrogen, as described in that Example. The coercive force of the pyrophoric material was 63.1 kA/m.

EXAMPLE 4

A γ-FeOOH having a specific surface area of 30 $m^2/g$ was provided with a tin oxide coating by neutralizing an acidic $SnCl_2$-containing aqueous suspension of the particles, as described in German Published Application DAS No. 1,907,697. The amount of tin was 1% by weight, based on FeOOH. After this step, and in the same dispersion, a further coating comprising 3% by weight of olive oil was produced by adding the latter substance. The FeOOH treated in this manner was reduced to the metal at 370° C. in a stream of 30 liters (S.T.P.)/hour of hydrogen for 7 hours. The results of the measurements on the pyrophoric material (py) and on a material passivated with acetone in the presence of air (pa) are shown in Table 3.

EXAMPLE 5

The procedure described in Example 4 was followed, except that the material treated with tin oxide/olive oil was first reduced to $FeO_{1.33}$ in a stream of nitrogen at 520° C. in the course of 30 minutes and only thereafter reduced with hydrogen to the metal and passivated, as described in Example 4. The results of the measurements are shown in Table 3.

| | $H_c$ [kA/m] | $M_m/\rho$ [$nTm^3/g$] | $S_{N2}$ [$m^2/g$] |
|---|---|---|---|
| Example 4 (py) | 65.0 | 89 | 23.8 |
| Example 4 (pa) | 69.5 | 70 | |
| Example 5 (py) | 68.4 | 90 | 28.5 |
| Example 5 (pa) | 75.7 | 65 | |

EXAMPLE 6

0.6 g of $Na_2SiO_2$ was dissolved in 900 ml of water, 75 g of γ-FeOOH ($S_{N2}$=30 $m^2/g$) were suspended in this solution, the pH was brought to 4.6 by adding 2.5 ml of 5% strength HCl, and 2.46 ml of olive oil were then added. The product was filtered off and dried at 120° C., and the material obtained was reduced to the metal in a stream of hydrogen at 370° C. for 7 hours. The results of the measurements are shown in Table 4.

COMPARATIVE EXPERIMENT 4

The procedure described in Example 6 was followed, except that the addition of olive oil was omitted. The results of the measurements are shown in Table 4.

TABLE 4

| | $H_c$ [kA/m] | $M_m/\rho$ [$nTm^3/g$] | $S_{N2}$ [$m^2/g$] |
|---|---|---|---|
| Example 6 | 63.2 | 80 | 29.6 |
| Comparative Experiment 4 | 62.4 | 76 | 21.8 |

EXAMPLE 7

A mixture which contained γ-FeOOH and 13% by weight of γ-FeOOH, had a specific surface area $S_{N2}$ of 77.3 $m^2/g$ and was prepared as described in German Laid-Open Application DOS No. 1,592,398 was dispersed in water. Thereafter, 1.5% by weight of $H_3PO_4$ and 4% by weight of olive oil were added to the suspension, while continuing vigorous stirring. When the addition was complete, dispersing was continued for a further 20 minutes, after which the mixture was filtered and the filter cake was dried at 80° C. under reduced pressure in a cabinet dryer. This material was then reduced to the metal in a stream of hydrogen at 350° C. for 8 hours. The results of the measurements are shown in Table 5.

EXAMPLE 8

The procedure described in Example 7 was followed, except that the material treated with phosphoric acid-/olive oil was first reduced in a stream of nitrogen at 470° C. in the course of 30 minutes to $FeO_{1.33}$, and this was then reduced to the metal, as described above. The results of the measurements are shown in Table 5.

TABLE 5

| | 160 kA/m | After saturation $S_{N2}$ | | |
|---|---|---|---|---|
| | $M_m/\rho$ | $M_r/\rho$ | $H_c$ | [$m^2/g$] |
| Example 7 | 166 | 95 | 61.1 | 30.9 |
| Example 8 | 144 | 96 | 70.5 | 42.2 |

EXAMPLE 9

5 kg of γ-FeOOH ($S_{N2}=31$ $m^2/g$) were suspended in 40 liters of water in a 60 liter vessel. 100 g of $H_3PO_4$ and 150 g of olive oil were stirred into 4 liters of water, and the mixture was added to the suspension, while stirring vigorously. Thereafter, the suspension was pumped through an intensive mill at a rate of 80 kg/hour, the resulting suspension was filtered and the product was dried at 130° C. (γ-FeOOH containing 1.8% of $PO_4^{3-}$ and 1.3% of carbon). The FeOOH treated in this manner was reduced in a stream of nitrogen at 475° C. to $FeO_{1.35}$, which was then reduced to the metal with of hydrogen at 340° C. in a fluidized-bed reactor. The specific surface area of the metal particles was 26.6 $m^2/g$. The magnetic properties of a sample passivated with acetone/air were as follows: at 160 kA/m:$H_c=69.2$, $M_r=62$ and $M_m=112$; after magnetization to saturation in a charge capacitor: $H_c=77.0$ and $M_r=79$.

EXAMPLE 10

In a 1 $m^3$ kettle, 40 kg of α-FeOOH ($S_{N2}=50$ $m^2/g$) were mixed with 700 liters of water, and the mixture was stirred vigorously for 3 hours, after which a mixture of 50 liters of water, 612 g of 85% strength phosphoric acid and 1.2 kg of olive oil was added slowly. Stirring was then continued for a further 5 hours, after which the product was filtered off and dried in the air at 120° C. 4 kg of α-FeOOH treated in this manner were then reduced to $FeO_{1.33}$ in an $N_2$ stream at 475° C. in a rotary kiln by a batchwise procedure. This $FeO_{1.33}$, which contained 0.36% of $PO_4^{3-}$ and 0.86% of carbon and had an $S_{N2}$ of 38.7 $m^2/g$, was then reduced to the metal with 8.25 $m^3$ (S.T.P.)/hour of $H_2$ at 340° C. in a stirred fixed bed, and the product was stabilized at 40° C. with an $N_2$/air mixture. The results of the measurements are shown in Table 6.

EXAMPLE 11

The procedure described in Example 10 was followed, except that, instead of adding phosphoric acid-/olive oil, a mixture of 761 g of $SnCl_2.2H_2O$ and 1.2 kg of olive oil was added to the suspension, and thereafter air was passed through for 2 hours. The first stage of the reduction gave $FeO_{1.34}$ containing 1.2% of Sn and 0.13% of carbon, and the reduction to the metal was carried out at 310° C. in a fluidized-bed furnace. The results of the measurements on a sample stabilized with a nitrogen/air mixture at 40° C. are shown in Table 6.

TABLE 6

| | After saturation | | $S_{N2}$ |
|---|---|---|---|
| | $H_c$ | $M_r/\rho$ | [$m^2/g$] |
| Example 10 | 87.7 | 88 | 25 |
| Example 11 | 90.2 | 90 | 23.3 |

EXAMPLE 12

250 g of γ-FeOOH ($S_{N2}=50.2$ $m^2/g$) were dispersed in 5 liters of water for 10 minutes, a solution of 23 g of 15% strength waterglass in 500 ml of water was added and dispersing was continued for a further 30 minutes. The solid product was filtered off and dried at 80° C. under 25 mm Hg for 40 hours. 35 g of this product were mixed with 1.1 g of polyethylene (molecular weight 250,000), and the mixture was heated at 550° C. for 37 minutes in a 250 ml rotating flask. After cooling to 370° C., the sample was reduced in a stream of hydrogen for 32 hours, and the product was cooled to room temperature and then oxidized superficially for 8 hours in a stream comprising 99% of $N_2$ and 1% of $O_2$.

The resulting powder had the following properties after magnetization to saturation in a charge capacitor:

$H_c=87.3$[kA/m] and $M_r/\rho=61$[$nTm^3/g$].

EXAMPLE 13

250 g of α-FeOOH ($S_{N2}=51.5$ $m^2/g$) were converted as described in Example 12. The resulting product had the following properties: $H_c=93.9$ [kA/m] and $M_r/\rho=80$ [$nTm^3/g$].

EXAMPLE 14

3 kg of α-FeOOH ($S_{N2}=52$ $m^2/g$) were predispersed in 60 liters of water in a vessel. After 15 minutes, 42 ml of an 85% strength $H_3PO_4$ and 30 g of oxalic acid ($H_2C_2O_4.2H_2O$), both dissolved in a total of 400 ml of $H_2O$, were added in the course of 5 minutes, while stirring was continued. Dispersing was carried out for a further 15 minutes, after which the mixture was filtered and the filter cake was dried at 130° C. The treated α-FeOOH had the following properties (sample A): $S_{N2}=51.7$ $m^2/g$; $PO_4^{3-}=1.1\%$ by weight; C=0.05% by weight.

80 g portions of sample A were dehydrated in the air at various temperatures. The conditions and results are summarized in the Table.

| Sample | Time [hours] | Temperature [°C.] | $S_{N2}$ of the dehydrated product [$m^2/g$] |
|---|---|---|---|
| B 1 | 7 | 250 | 99.2 |
| B 2 | 1 | 500 | 44.0 |
| B 3 | 1 | 700 | 25.2 |

40 g of the dehydrated products B 1, B 2 and B 3 were mixed with 3% by weight of stearic acid, and the mixture was then kept for 1 hour at 100° C. in an oven. The samples were then reduced to $FeO_{1.35}$ in a stream of 10 liters (S.T.P.)/hour of nitrogen at 360° C. in the course of 30 minutes, after which the $FeO_{1.35}$ was not isolated but was reduced directly with hydrogen at 360° C. to iron. The results are shown in Table 7.

TABLE 7

| Sample | $H_c$ kA/m | $S_{N2}$ $m^2/g$ |
|---|---|---|
| B 1 | 89.1 | 31.9 |
| B 2 | 85.6 | 30.4 |
| B 3 | 90.4 | 23.5 |

EXAMPLE 15

1,800 g of steel balls having a diameter of 4 mm, 100 parts of the metal particles described in Example 9, 3 parts of Lecithin, 9 parts of a silicate-based filler, 110 parts of a solvent mixture comprising equal parts of tetrahydrofuran and dioxane, and 127 parts of a 13.5% strength binder prepared by dissolving 13.75 parts of an elastomeric polyester-urethane obtained from adipic acid, butane-1,4-diol and 4,4'-diisocyanatodiphenylmethane and 3.4 parts of a polyphenoxy resin having a molecular weight of 30,000 in 109.85 parts of a mixture of equal parts of tetrahydrofuran and dioxane were introduced into the 1.8 liter drum of a Laboratory stirred ball mill, and milling was carried out for 14 hours at a speed of 1,500 rpm. When dispersing was complete, 6.3 parts of a 75% strength solution of a triisocyanate obtained from 3 moles of toluylene diisocyanate and 1 mole of 1,1,1-trimethylolpropane in ethyl acetate were added to the dispersion and stirring was continued for 15 minutes. The dispersion was filtered and then applied as a layer to a 12 μm thick polyethylene terephthalate film, the magnetic particles being oriented at the same time by means of a permanent magnet. After drying, the magnetic layer was calendered by passing the coated film between heated steel rollers. The resulting magnetic layer was 4 μm thick. The magnetic films obtained in this manner were slit into 3.81 mm wide magnetic tapes, which were tested. The magnetic properties were measured in a magnetic field of 160 kA/m. The coercive force $H_c$ in [kA/m], the residual induction $M_r$ and saturation magnetization $M_m$ in [mT] and the orientation ratio Rf, ie. the ratio of the residual induction in the preferred direction of particle orientation to that at right angles to this direction, are given. The reference level-to-weighted noise ratio $RG_A$ was measured against the reference tape IEC IV, and the signal-to-print-through ratio $K_o$ was determined. The results are shown in Table 8.

EXAMPLE 16

The procedure described in Example 15 was followed, except that the metal particles obtained as described in Example 10 were employed. The results are shown in Table 8.

EXAMPLE 17

The procedure described in Example 15 was followed, except that the metal particles obtained as described in Example 11 were employed. The results are shown in Table 8.

EXAMPLE 18

The procedure described in Example 15 was followed, except that the metal particles obtained as described in Example 12 were employed. The results are shown in Table 8.

TABLE 8

| | Example 15 | Example 16 | Example 17 | Example 18 |
|---|---|---|---|---|
| $H_c$ | 78.6 | 80.9 | 83.8 | 90.0 |
| $M_r$ | 252 | 220 | 221 | 239 |
| $M_m$ | 315 | 301 | 305 | 341 |
| $R_f$ | 2.4 | 1.8 | 1.9 | 1.5 |
| Reference level-to-weighted noise ratio $RG_A$ | +0.6 | +2.1 | +1.6 | +0.4 |
| Signal-to-print-through ratio $K_o$ | 54.0 | 56.0 | 55.5 | 57.0 |

We claim:

1. A process for the preparation of acicular ferromagnetic metal particles consisting essentially of iron by reducing acicular iron(III) oxide hydroxide provided with a shape-stabilizing surface coating, or the iron(III) oxide obtained therefrom by dehydration, wherein the reduction is carried out with a decomposable organic compound and hydrogen at from 270° to 450° C.

2. A process for the preparation of acicular ferromagnetic metal particles consisting essentially of iron by reducing acicular iron(III) oxide hydroxide provided with a shape-stabilizing surface coating, or the iron(III) oxide obtained therefrom by dehydration, wherein, in a first stage, the iron(III) oxide hydroxide or iron(III) oxide provided with a surface coating is reduced with a decomposable organic compound in an inert gas atmosphere at from 270° to 650° C. to $FeO_x$, where x is from 1.33 to 1.44, and, in a second stage, this product is reduced with hydrogen at from 270° to 450° C. to the metal.

* * * * *